US009320327B2

(12) United States Patent
Ikeguchi et al.

(10) Patent No.: US 9,320,327 B2
(45) Date of Patent: Apr. 26, 2016

(54) KNITTED SLIDE FASTENER

(75) Inventors: Yoshito Ikeguchi, Toyama (JP); Norio Uozumi, Toyama (JP); Hidenobu Kato, Toyama (JP)

(73) Assignee: YKK Corporation (JP)

( * ) Notice: Subject to any disclaimer, the term of this patent is extended or adjusted under 35 U.S.C. 154(b) by 321 days.

(21) Appl. No.: 13/517,986

(22) PCT Filed: Dec. 25, 2009

(86) PCT No.: PCT/JP2009/071669

§ 371 (c)(1),
(2), (4) Date: Jun. 21, 2012

(87) PCT Pub. No.: WO2011/077568

PCT Pub. Date: Jun. 30, 2011

(65) Prior Publication Data

US 2012/0279025 A1 Nov. 8, 2012

(51) Int. Cl.

| | |
|---|---|
| ***A44B 1/04*** | (2006.01) |
| ***A44B 19/56*** | (2006.01) |
| ***A44B 19/34*** | (2006.01) |
| ***D04B 21/16*** | (2006.01) |

(52) U.S. Cl.
CPC ..... *A44B 19/56* (2013.01); *A44B 19/343* (2013.01); *D04B 21/16* (2013.01); *D10B 2501/0631* (2013.01); *Y10T 24/2591* (2015.01)

(58) Field of Classification Search
CPC ..... A44B 19/343; A44B 19/32
USPC ..... 24/432
See application file for complete search history.

(56) References Cited

U.S. PATENT DOCUMENTS

| | | | | |
|---|---|---|---|---|
| 568,177 | A | 9/1896 | Tesla | |
| 4,724,586 | A * | 2/1988 | Tsubokawa et al. | 24/384 |
| 5,540,064 | A | 7/1996 | Matsuda et al. | |
| 5,802,883 | A | 9/1998 | Matsuda et al. | |

(Continued)

FOREIGN PATENT DOCUMENTS

| | | | | |
|---|---|---|---|---|
| EP | 0743025 | A2 | 11/1996 | |
| EP | 0823225 | A3 | 1/1999 | |
| EP | 1048238 | A2 * | 11/2000 | A44B 19/34 |
| EP | 1563753 | A1 | 8/2005 | |

(Continued)

OTHER PUBLICATIONS

International Search Report and Written Opinion, PCT Internationai Application No. PCT/JP2009/071669, mailed Apr. 6, 2010.

*Primary Examiner* — Robert J Sandy
*Assistant Examiner* — Matthew Sullivan
(74) *Attorney, Agent, or Firm* — Kilpatrick Townsend & Stockton LLP

(57) ABSTRACT

A knitted slide fastener in which a stable knitted mode of a knitting structure is maintained, and a fastener element row is strongly attached to a warp knitting fastener tape. A fixing chain knitting yarn of the fastener element row in the fastener element attaching portion and knitting yarns configuring a ground structure are knitted with independent single structures, respectively. Needle loops which are connected to each other in a longitudinal direction of the fixing chain knitting yarn mounts each of element legs of the continuous fastener element row, sinker loops which are connected to each other in the longitudinal direction of the fixing chain knitting yarn go under a sinker loop of a second warp knitting yarn which configures the ground structure and cross each other.

8 Claims, 3 Drawing Sheets

(56) References Cited

U.S. PATENT DOCUMENTS

| | | | | |
|---|---|---|---|---|
| 5,857,359 | A | 1/1999 | Matsuda et al. | |
| 5,924,311 | A | 7/1999 | Matsuda et al. | |
| 7,076,846 | B2 * | 7/2006 | Arai | 24/432 |
| 8,667,652 | B2 * | 3/2014 | Thomas et al. | 24/389 |
| 2002/0184926 | A1 | 12/2002 | Matsuda | |
| 2005/0178161 | A1 | 8/2005 | Matsuda et al. | |
| 2008/0201918 | A1 * | 8/2008 | Takazawa et al. | 24/434 |

FOREIGN PATENT DOCUMENTS

| | | |
|---|---|---|
| JP | 8-228813 | 9/1996 |
| JP | 8-299034 | 11/1996 |
| JP | 8-308613 | 11/1996 |
| JP | 10-5010 | 1/1998 |
| JP | 10-42916 A | 2/1998 |
| JP | 2002-360316 | 12/2002 |
| JP | 2005-230040 | 9/2005 |

* cited by examiner

KNITTED SLIDE FASTENER

This application is a national stage application of PCT/JP2009/071669 which is incorporated herein by reference.

TECHNICAL FIELD

The invention relates to a woven slide fastener which knits a fastener tape and which weaves and attaches a continuous fastener element row to a fastener element attaching portion of an edge portion on a longitudinal side of the fastener tape, and more particularly, to a woven slide fastener which knits the fastener element attaching portion using a double warp knitting machine.

BACKGROUND ART

As a conventional woven slide fastener, according to Japanese Patent Application Laid-Open (JP-A) No. 10-5010 (Patent Document 1) for example, a continuous fastener element row which is knitted onto a fastener element attaching portion using a single-bed-type warp knitting machine having a single needle bed is fixed by fixing chain knitting yarns of two wales or more, each needle loop of each fixing chain knitting yarn presses a leg of each element of the continuous fastener element row from above toward a ground structure, warp in-laid yarns are intermingled with, warp inserted and knitted onto at least some of sinker loops of a sinker loop group to stabilize the fastener element row in size, and to prevent disengagement of the fastener element.

JP-A No. 2002-360316 (Patent Document 2) discloses a woven slide fastener which knits likewise using a single-bed-type warp knitting machine, its fastener element attaching portion is knitted by fixing knitting yarns and other knitting yarns which sandwich and fix upper end lower legs of each fastener element in a front-back direction, composite fiber yarns including heat-shrinkable fiber material and heat-fusion fiber material are employed as a portion of the configuration yarns, the heat-shrinkable fiber material is shrunk by heating treatment, the heat-fusion fiber material is fused on the other peripheral configuration yarns, and the fastener element attaching portion is highly densified to enhance a fastening force with respect to the fastener element. Even if yarns which configure the element attaching portion of the fastener tape are cut by interference with a sewing needle at the time of sewing operation, a fray is not generated, and a fastener element row at that portion is not separated from the fastener tape.

The fastener element of the fastener element attaching portion of the woven slide fastener which knits using the single-bed-type warp knitting machine disclosed in Patent Documents 1 and 2 is attached by pressing the leg of the fastener element toward the ground structure by the needle loop of the fixing chain knitting yarn, and the fastener element is supported by a sinker loop of the fixing chain knitting yarn and warp in-laid yarn which configure the ground structure. Hence, the density of ground structure itself is likely to be coarse, and since the sinker loop and the weft in-laid yarn are likely to expand and shrink in the length direction of the tape, the fastener element can not be stably fixed. Further, since tension greater than those of other knitting yarns is applied to the fixing chain knitting yarn, the sinker loop is pulled up along a side surface of the leg of the fastener element by the needle loop. Therefore, the ground structure portion is likely to be corrugated into an uneven surface, and outward appearance becomes poor.

In Patent Documents 1 and 2, to strongly fix the fastener element to the fastener element attaching portion knitted by the single-bed-type warp knitting machine, or to improve the poor outward appearance, countermeasure is taken in addition to normal knitting. For example, warp in-laid yarn is inserted in between sinker loops which are connected to each other in a tape length direction of the fixing chain knitting yarn in a zigzag form, or composite fiber yarns including heat-shrinkable fiber material and heat-fusion fiber material are used as the fixing chain knitting yarn.

To solve the problem of the single structure using the single-bed-type warp knitting machine, JP-A No. 8-228813 (Patent Document 3), JP-A No. 8-299034 (Patent Document 4) and JP-A No. 2005-230040 (Patent Document 5) propose that a fastener element attaching portion is knitted with double structure using a double-bed-type warp knitting machine such as a double raschel knitting machine having two rows of needle beds. According to any of the fastener element attaching portion of the slide fastener described in Patent Documents 3 to 5, the same fixing chain knitting yarn is knitted by double structure using front and back two rows of knitting-needles.

This will be described specifically. According to the fastener element attaching portion disclosed in Patent Documents 3 to 5, its ground structure is knitted using a back needle row, and its fixing chain knitting yarn is knitted using front and back two rows of needle beds. Hence, a needle loop formed by the front needle row of the fixing chain knitting yarn is knitted to straddle the fastener element and in a subsequent course, a needle loop is formed by the front needle row, and a needle loop formed by the front needle row intermingles with the former needle loop, i.e., the needle loop is knitted by a so-called double structure. These are alternately repeated. That is, a needle loop for pressing a fastener element is formed using the front needle row on a leg of the fastener element disposed between two rows of courses, and during a subsequent course, when a needle loop of ground configuration knitting yarn is formed by the back needle row, the fixing chain knitting yarn is formed on the same back needle row by intermingling a needle loop of a next course with the former needle loop of the ground configuration knitting yarn at the same time.

Knitting yarns used for aground structure knitted by the back needle row in the fastener element attaching portion disclosed in Patent Documents 3 to 5 are warp knitting yarns of any of ground structure chain knitting yarns, tricot knitting yarns and second warp knitting yarns or a combination of them. A warp in-laid yarn or a weft in-laid yarn is inserted into a sinker loop of knitted stitches which are connected in a longitudinal direction or a width direction of the ground structure knitted by these knitting yarns.

Since the fixing chain knitting yarn is knitted onto the fastener element attaching portion such that the double structure using a double-bed-type warp knitting machine is included, the fastener element row is strongly attached to an edge portion on the longitudinal side of the warp knitting fastener tape stably in size, elongation of the fastener element attaching portion is suppressed at the same time, disengagement when the fastener chain is folded is eliminated, and smooth engagement can be carried out.

PRIOR ART DOCUMENT

Patent Document

Patent Document 1: Japanese Patent Application Laid-Open (JP-A) No. 10-5010

Patent Document 2: JP-A No. 2002-360316
Patent Document 3: JP-A No. 8-228813
Patent Document 4: JP-A No. 8-299034
Patent Document 5: JP-A No. 2005-230040

SUMMARY OF THE INVENTION

Problems to be Solved by the Invention

The fastener element attaching portion of the woven slide fastener described in Patent Documents 3 to 5 is fixed to the fastener element row by the fixing chain knitting yarn which is knitted while partially including double structure. Therefore, a form of the ground structure is stabilized and the above-described excellent effect is exerted. However, density of the fastener element attaching portion becomes high, double structure alternately exists between ground structure courses by the fixing chain knitting yarn of the fastener element attaching portion, and two needle loops of at least the ground structure chain knitting yarn and the fixing chain knitting yarn are formed by the same knitting-needle of the front tow. Therefore, a large load is applied to the front knitting-needle, and generation of breakage is increased.

Further, tension greater than those of other knitting yarns is applied to the fixing chain knitting yarn, if the fixing chain knitting yarn with high tension applied is intermingled with the ground structure, the ground structure is strongly fastened by the fixing chain knitting yarn, and hardness of the entire fastener element attaching portion is increased. As a result, characteristics of the warp knitting slide fastener which is originally required to have flexibility can not sufficiently be exerted. Especially in the case of thin, long and small slide fastener having narrow fastener tape width, the influence is great.

It is a major object of the invention to provide a woven slide fastener in which the conventional fastener element attaching portion partially including the double structure is eliminated, flexibility which is originally required by warp woven slide fastener is secured, a knitting mode of the ground structure of the fastener element attaching portion is stabilized, and the fastener element row can be strongly supported and fixed.

Means for Solving the Problems

To achieve the above object, the invention provides a knitted slide fastener including a tape body of a fastener tape, and a fastener element attaching portion disposed on a side edge portion in a longitudinal direction of the tape body of the fastener tape, in which the fastener tape is knitted and a continuous fastener element row is knitted on the fastener tape, being characterized in that at least two rows of wales include a fixing chain knitting yarn and multiple knitting yarns configure a ground structure in the tape body and the fastener element attaching portion, needle loops which are connected to each other in the longitudinal direction of the fixing chain knitting yarn mount each of the element legs of the continuous fastener element row to the fastener element attaching portion, and sinker loops which are connected to each other in the longitudinal direction of the fixing chain knitting yarn go under a sinker loop of at least one of the knitting yarns of the ground structure in the fastener element attaching portion, and the sinker loops cross each other.

According to preferable aspects, the knitting yarn which configures the ground structure includes a second warp knitting yarn, the sinker loop of the fixing chain knitting yarn goes under and crosses a sinker loop of the second warp knitting yarn. Preferably, all of wales of the tape body except a ground structure including a single structure of the fastener element attaching portion are knitted with a single structure which includes a tricot knitting yarn and a weft in-laid yarn. The fastener element attaching portion includes three or more wales, a ground structure includes a single structure of the fastener element attaching portion, the second warp knitting yarn is woven between the n−1-th wale which is most adjacent to the tape body and the n-th wale which is most adjacent to the fastener element attaching portion of the tape body, or a needle loop of the second warp knitting yarn woven in the n-th wale of the tape body which is most adjacent to the ground structure of the fastener element attaching portion including a single structure is knitted such that the needle loop of the second warp knitting yarn intertwines with a needle loop of a tricot yarn of the tape body which configures the n-th wale, or second warp knitting yarns are woven between all of wales of the ground structure which includes a single structure of the fastener element attaching portion, and a second warp knitting yarn is woven in a ground structure between the first wale on an outermost side of the fastener element attaching portion and the second wale which is adjacent to the first wale. Further, a chain knitting yarn is woven in three or more wales of the tape body including the wale having a single structure which is most adjacent to the fastener element attaching portion of the tape body.

Effect

In the invention, the first feature is that when the fastener element attaching portion is knitted using the warp knitting machine having two or more needle beds, the needle loop of the ground structure of the fastener element attaching portion and the needle loop of the knitted portion of the fixing chain knitting yarn are independently knitted so that the needle loops do not intermingle with each other. By employing this configuration, the ground structure is independently knitted by the warp knitting needle row of one of the needle beds, the fixing chain knitting yarn is knitted by the warp knitting needle row of the other needle bed such that the leg of the fastener element is pressed toward the ground structure, the attaching operation and the fixing operation of the fastener element row by the ground structure and the fixing chain knitting yarn are separated, the phenomenon that the ground structure receives direct and strong restraint from the fixing chain knitting yarn is eliminated, a load applied to the warp knitting needle which knits the ground structure is reduced, and stability of the knitting mode of the ground structure is secured. As a result, flexibility of the entire fastener element attaching portion can be secured, and breakage of the warp knitting needle can be avoided.

The second feature of the invention is that when the fastener element attaching portion is knitted, one of two or more warp knitting needle rows is exclusively used for the ground structure, other needle rows are used for knitting portion of the fixing chain knitting yarn, both the knitting operations are carried out independently, and when a second warp knitting yarn is included in the ground structure, the one second warp knitting yarn having one needle loop forms a needle loop through a sinker loop in the wale direction and the course direction and therefore, tension applied to the second warp knitting yarn is blocked between the needle loops and is not applied to the entire region, and the knitting mode of the entire ground structure is stabilized. In the invention, the sinker loops of the fixing chain knitting yarn and the second warp knitting yarn of the ground structure cross each other such that one of the sinker loops comes to a side opposite from the other sinker loop while avoiding intermixture of the needle loop of the ground structure and the needle loop of the fixing chain knitting portion, and the ground structure and the fixing chain knitting portion are connected to each other.

By employing such a configuration, the fixing chain knitting portion and the ground structure are connected to each other through their sinker loops, the fastener element row is pressed toward the ground structure by the needle loop of the fixing chain knitting portion, the ground structure independently and strongly supports the fastener element row toward the fixing chain knitting portion, the knitting mode and flexibility of the ground structure are secured, and the fastener element row can be reliably, strongly and stably attached and fixed to the fastener element attaching portion without breaking the attaching mode of the element.

The invention will be understood in more detail by the following specific embodiments.

MODE FOR CARRYING OUT THE INVENTION

A preferred exemplary example of the invention will be described specifically with reference to the drawings based on embodiments.

Figure 1:
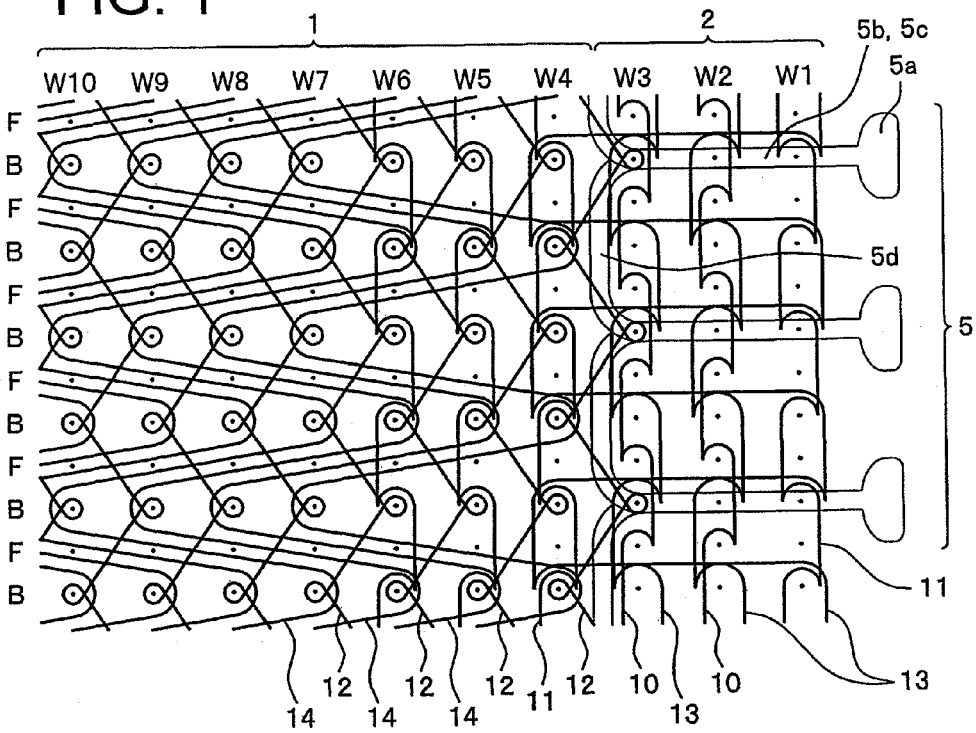
FIG. 1 is a structure diagram of a warp knitting structure showing a first embodiment of a fastener stringer in a thin-width slide fastener which is a typical exemplary example of the invention.
Figure 2:
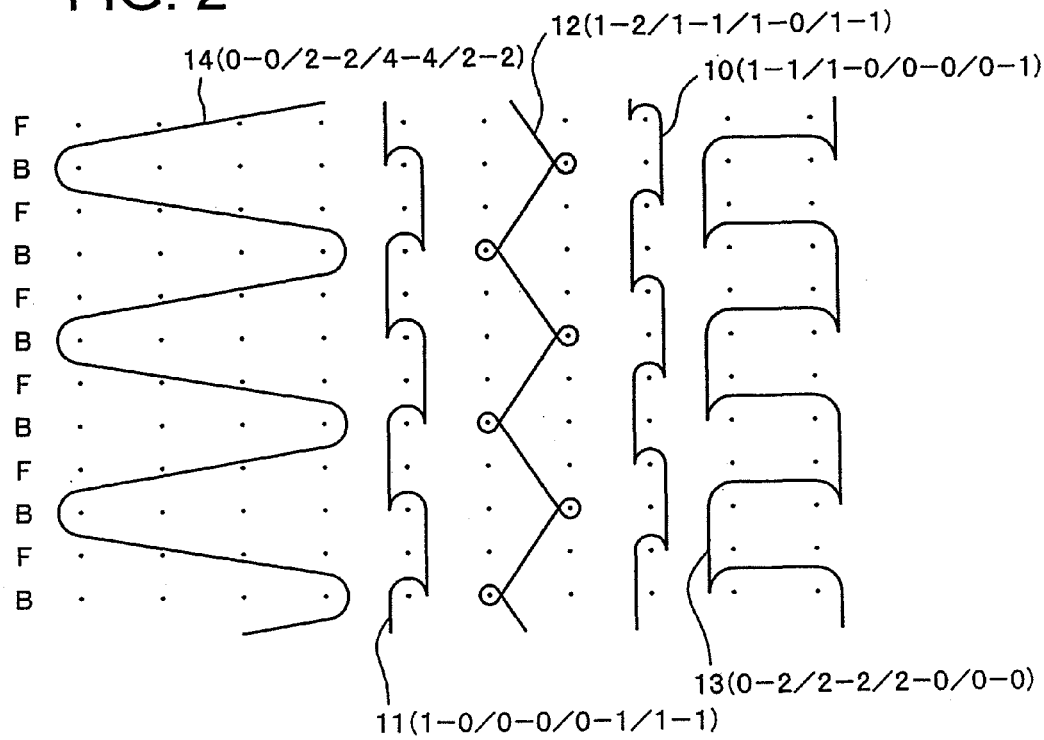
FIG. 2 is a structure diagram of configuration yarns of the fastener stringer of the embodiment.
Figure 3:
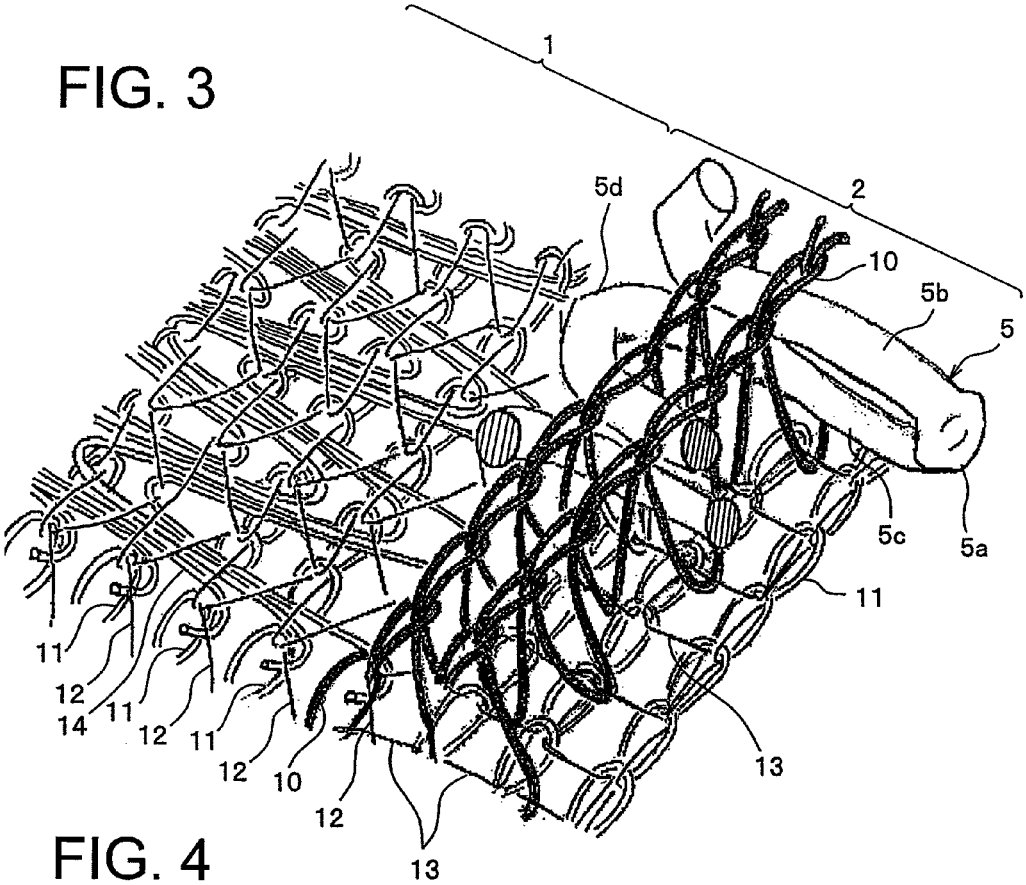
FIG. 3 is a partial enlarged cubic diagram schematically showing a partially cut-away fastener stringer of the embodiment.

FIGS. 1 to 3 show a first embodiment of the invention. A woven slide fastener of the first embodiment is knitted by a warp knitting machine (e.g., double raschel knitting machine) having two rows of back and front needle beds B and F. As shown in FIG. 1, the woven slide fastener of the invention includes a fastener tape body 1, and a fastener element attaching portion 2 on which an element row 5 is attached. The element row 5 includes a large number of continuous fastener elements along one side edge in a longitudinal direction of the fastener tape body 1. According to the example shown in the drawing, the fastener element attaching portion 2 includes three wales (W1 to W3) arranged from outside. Ground structures of the fastener tape body 1 and the element attaching portion 2 are knitted by a back needle BN. A fixing chain knitting yarn 10 which is woven by a front needle FN while pressing element legs of the element row 5 toward the ground structure.

As shown in FIGS. 1 and 2, all of structure yarns configuring the ground structure of the element attaching portion 2 are knitted by the back needle BN. The structure yarns include a chain knitting yarn 11 (1-0/0-0/0-1/1-1) which is knitted by the first wale W1, a tricot knitting yarn 12 (1-2/1-1/1-0/1-1) knitted between the third wale W3 and a fourth wale W4 which is adjacent to the element attaching portion 2 of the fastener tape body 1, and three second warp knitting yarns 13 (0-2/2-2/2-0/0-0) which are sequentially knitted from the first wale W1 to the fourth wale W4. The fixing chain knitting yarn 10 (1-1/1-0/0-0/0-1) is knitted by the front needle FN on the element attaching portion 2.

In this embodiment, a wale of the fastener element attaching portion 2 which is most adjacent to the tape body 1 is the third wale W3, and a wale of the tape body 1 which is most adjacent to the element attaching portion 2 is the fourth wale W4.

A knitting yarn which configures the ground structure forms a needle loop in every course along a single wale by the back needle BN. A needle loop of the chain knitting yarn 11 linearly connects needle loops which are adjacent to each other in the longitudinal direction of the fastener tape by a sinker loop, and this becomes a portion of the ground structure. The tricot knitting yarn 12 is a structure knitted such as to straddle two adjacent wales. After a needle loop is formed by the back needle BN, the tricot knitting yarn 12 is diagonally connected to a needle loop formed by the adjacent back needle BN in a next course using a sinker loop, and this becomes a portion of the ground structure.

As shown in FIGS. 1 and 2, the fastener tape body 1 is entirely knitted by the back needle BN. The fastener tape body 1 includes the tricot knitting yarn 12 (1-2/1-1/1-0/1-1) which is knitted through all wales (W4 to Wm), the chain knitting yarn 11 (1-0/0-0/0-1/1-1) which is knitted in three wales, i.e., the fourth to sixth wales (W4 to W6), and a weft in-laid yarn 14 (0-0/2-2/4-4/2-2) which is inserted such that the yarn 14 straddles four wales in a zigzag form. A coil-shaped fastener element row 5 which is woven simultaneously with knitting of the fastener tape on the element attaching portion 2 is a monofilament made of synthetic resin such as nylon and polyester, the fastener element row 5 runs such that it reciprocates in a lateral direction while changing a course C every three wales (W1 to W3) of the element attaching portion 2. As shown in FIG. 3, upper and lower legs 6 and 7 of each of the fastener elements are pressed toward the ground structure and fixed by the needle loop which is connected in the longitudinal direction (direction in which the wale extends) of the fastener tape of the fixing chain knitting yarn 10 on the two wales, i.e., the second and third wales W2 and W3.

Here, in the embodiment, in a warp knitting machine having the back and front two needle beds, all of the ground structures of the fastener tape are knitted by the back needle BN as described above, and the front needle knits the fixing chain knitting portion by the fixing chain knitting yarn 10, and this is common in all of later-described other subsequent embodiments also. That is, the ground structure and the fixing chain knitting portion are knitted as independent single structures and this is one of features. However, the ground structure and the fixing chain knitting portion are knitted such that sinker loops of knitted stitches of a portion of weft knitting yarns of the configuration knitting yarns 11 to 13 of the ground structure and the fixing chain knitting yarn 10 cross each other while reversing their running positions, and the ground structure and the fixing chain knitting portion are integrally formed, and this is other feature.

This will be described specifically. In this embodiment, as shown in FIG. 3, the needle loop NP of the fixing chain knitting yarn 10 is knitted by the front needle FN such that the upper end lower legs of the fastener element row 5 which is knitted on the element attaching portion 2 is pressed toward the ground structure. At that time, the ground structure is knitted by the back needle BN at the same time. At the time of the simultaneous knitting operation by the front needle FN and the back needle BN, the sinker loop of the knitted stitch by the fixing chain knitting yarn 10 is made to run such that the sinker loop goes under (on the side of the back needle) a sinker loop of the second warp knitting yarns 13 and both the sinker loops cross each other. The second warp knitting yarns 13 sequentially forms knitted stitches (needle loops) along a wale direction and a course direction of the element attaching portion due to its structural reason. Therefore, tension is blocked every one knitted stitch in a tape length direction (wale direction) and a width direction (course direction). Hence, even if the second warp knitting yarns 13 crosses the sinker loop of the fixing chain knitting yarn 10, tension of the second warp knitting yarns 13 and tension of the fixing chain knitting yarn 10 are balanced, the knitting mode of the ground structure is not deformed, a double structure portion in which the needle loop of the fixing chain knitting yarn and the needle loop of the second warp knitting yarns intermingle with each other does not exists unlike the conventional technique, knitting density of the element attaching portion 2 itself does not become dense, and although flexibility is secure, stable knitting mode is maintained. Since the needle loop of the ground structure and the needle loop of the fixing chain knitting portion do not intermingle with each other, an excessive load is not applied to the back needle BN, not only lifetime of the needle is increased but also the knitting speed is increased.

In this embodiment, three chain knitting yarns 11 are woven together with the tricot knitting yarn 12 from the fourth wale W4 to the sixth wale W6 (tape body 1) of the fastener tape. Since the three wales W4 to W6 are sliding portions of a slider (not shown), they are made dense to enhance their strengths, and their surfaces are smoothened so that the slider slides smoothly. In the wales W4 to Wm−1 of the fastener tape body 1, the weft in-laid yarn 14 is inverted with a needle loop of the tricot knitting yarn 12 every four wales, and runs between the courses. Another chain knitting yarn 11 having the same structure is also knitted in the outermost wale opposite from the element attaching portion 2 to stabilize a mode in the tape longitudinal direction.

Figure 4:
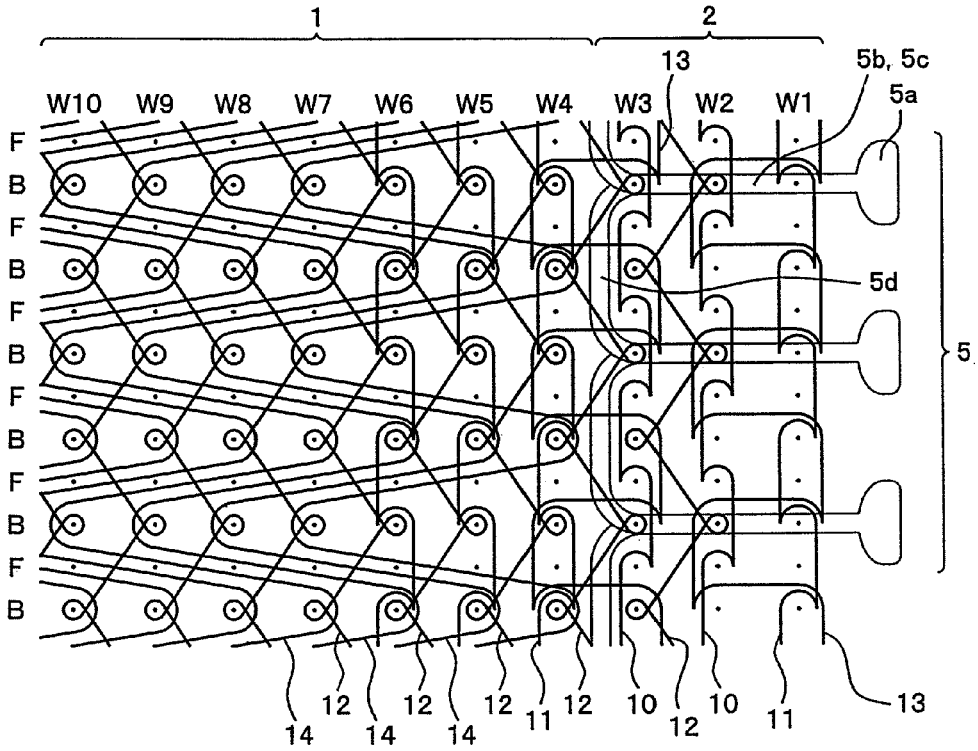
FIG. 4 is a structure diagram of a warp knitting structure showing a second embodiment of the invention.

FIG. 4 shows a second embodiment of the invention. As shown in FIG. 4, according to the second embodiment, the second warp knitting yarn 13 between the second wale W2 and the third wale W3 in the first embodiment is eliminated, and the tricot knitting yarn 12 (1-2/1-1/1-0/1-1) is knitted between the wales W2 and W3 by the back needle BN. Other structure is the same as that of the first embodiment. By employing the above-described structure in the second embodiment, only a partial second warp knitting yarn is eliminated from the element attaching portion 2, this yarn is replaced by the tricot knitting yarn 12 in which a sinker loop diagonally extends between the adjacent wales. Therefore, the tricot knitting yarn 12 enhances flexibility of the element attaching portion 2 utilizing the fact that the tricot knitting yarn 12 has resiliency in both the wale direction and course direction.

Figure 5:
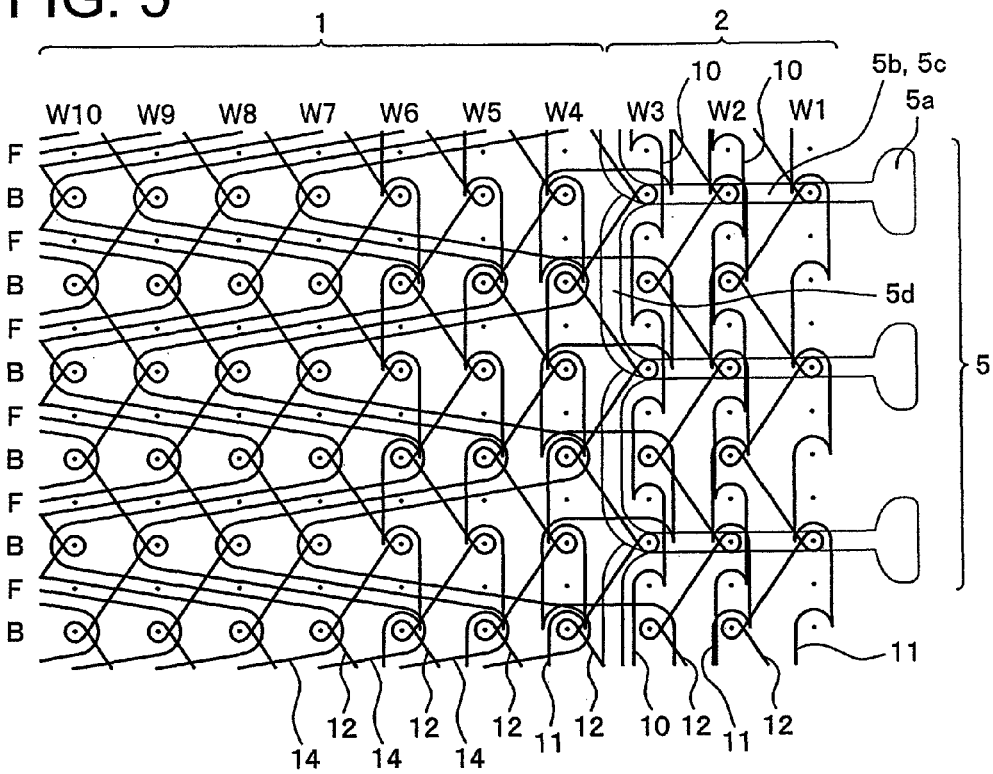
FIG. 5 is a structure diagram of a warp knitting structure showing a third embodiment of the invention.

FIG. 5 shows a third embodiment of the invention. In the third embodiment, the second warp knitting yarn 13 is woven between the third wale W3 and the fourth wale W4 located at a position where the tape body 1 of the fastener tape and the element attaching portion 2 are switched, and the tricot knitting yarn 12 is woven using the back needle BN instead of eliminating the second warp knitting yarn of the first to third wales W1 to W3 in the first embodiment. The tricot knitting yarn 12 is woven in the first wale W1 and the second wale W2 located on the side of the edge of the fastener tape. Other structure is the same as that of the first embodiment. In the third embodiment, according to the above-described configuration, resiliency in the wale direction and the course direction is suppressed at the switching position of the tape body 1 of the fastener tape and the element attaching portion 2, the knitting by the second warp knitting yarn which maintains stable weaving mode and the knitting by the tricot knitting yarn 12 which provides a next structure in the element attaching portion 2 with slight resiliency in the tape longitudinal direction and the width direction are combined, the mode in the switching portion of the fastener tape body 1 and the element attaching portion 2 is stabilized, and flexibility in the element attaching portion 2 is secured.

Figure 6:
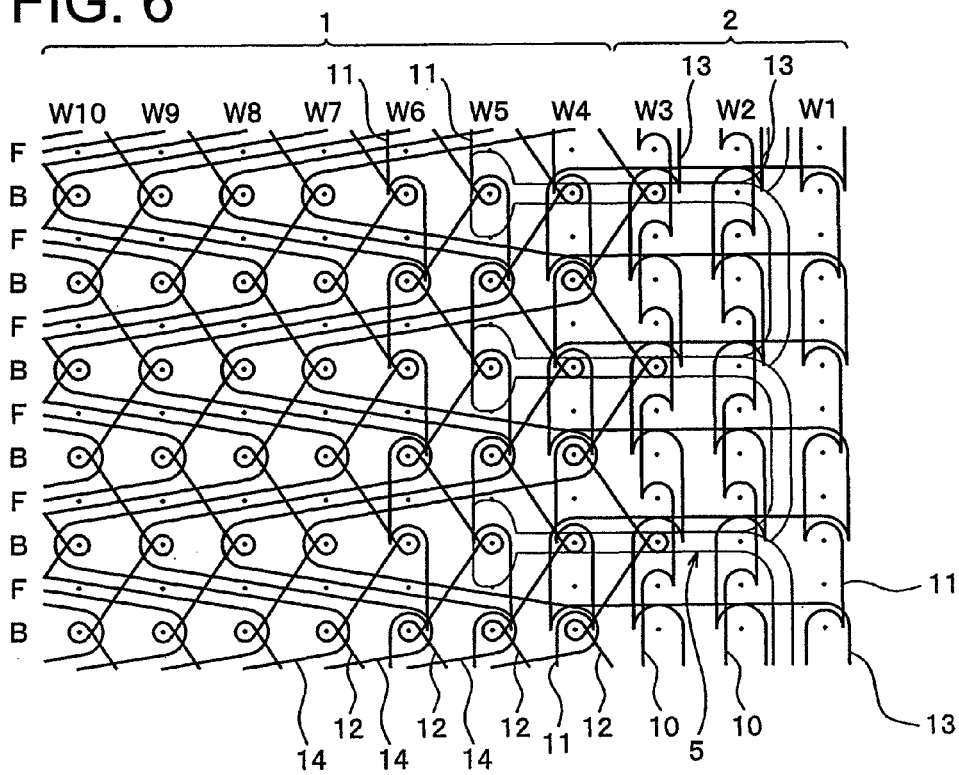
FIG. 6 is a structure diagram of a warp knitting structure showing a fourth embodiment of the invention.

FIG. 6 shows a fourth embodiment of the invention. This example is different from the first embodiment in that a fastener element row 5 is woven in the element attaching portion 2 such that reversed portions 5*d* which connect coupling heads 5*a* and upper and lower legs 5*b* and 5*c* with each other in the elements of the fastener element row 5 which is continuously woven onto the element attaching portion 2 in a zigzag form are disposed in a reversed direction in the tape width direction. That is, in this embodiment, the coupling heads 5*a* of the fastener element row 5 extend toward the fastener tape body 1 beyond the element attaching portion 2, the reversed portions 5*d* of the fastener element row 5 are disposed side by side along an outer edge of the element attaching portion 2. Other configuration is the same as that of the first embodiment. The tape body 1 of the fastener tape and the element attaching portion 2 are folded into two along the tape length direction, and a cross section of the fastener tape edge is formed into a U-shape. Accordingly, a hidden slide fastener in which a coupling head 5*a* is coupled to another coupling head 5*a* of the opposed element row 5 is obtained. The embodiment of the hidden slide fastener has the above-described configuration, but in the other embodiments also, the knitting structures of the second and third embodiments can be employed as they are for the configuration itself of the fastener tape.

The first to fourth embodiments are merely typical examples of the invention, and it will be understood that the invention can be variously modified without departing from a spirit of the invention.

DESCRIPTION OF REFERENCE NUMERALS

1 Fastener tape body (tape body)
2 Fastener element attaching portion
5 Element row
5*a* Coupling head
5*b*, 5*c* Upper and lower legs
5*d* Reversed portion
10 Fixing chain knitting yarn
11 Chain knitting yarn (of ground structure)
12 Tricot knitting yarn (of ground structure)
13 Second warp knitting yarn (of ground structure)
14 Weft in-laid yarn (of ground structure)

The invention claimed is:

1. A knitted slide fastener, comprising:

a tape body of a fastener tape, and a fastener element attaching portion disposed along a side edge portion in a longitudinal direction of the tape body of the fastener tape, wherein the fastener tape is knitted and a continuous fastener element row is knitted on the fastener element attaching portion, a plurality of knitting yarns configure a ground structure in the tape body and the fastener element attaching portion and each of at least two rows of wales in the fastener element attaching portion includes a fixing chain knitting yarn, wherein the ground structure includes at least one second warp knitting yarn, the fixing chain knitting yarn includes first, second, and third needle loops, which are consecutive needle loops of the fixing chain knitting yarn connected to each other in the longitudinal direction, wherein the second needle loop mounts element legs of the continuous fastener element row to the fastener element attaching portion, and each of two sinker loops extending toward the ground structure from the second needle loop goes under a respective sinker loop of the at least one second warp knitting yarn, wherein the respective sinker loops are adjacently arranged in the longitudinal direction.

2. The knitted slide fastener according to claim 1, wherein the knitted slide fastener is a hidden slide fastener.

3. The knitted slide fastener according to claim 1, wherein all wales of the tape body include a tricot knitting yarn and a weft in-laid yarn.

4. The knitted slide fastener according to claim 3, wherein the fastener element attaching portion includes three or more wales, the second warp knitting yarn is knitted between a wale in the fastener element attaching portion which is most adjacent to the tape body and a wale in the tape body which is most adjacent to the fastener element attaching portion.

5. The knitted slide fastener according to claim 3, wherein a needle loop of the second warp knitting yarn knitted in a wale of the tape body which is most adjacent to the fastener element attaching portion is knitted such that the needle loop of the second warp knitting yarn intertwines with a needle loop of the tricot knitting yarn of the tape body which configures the wale.

6. The knitted slide fastener according to claim 3, wherein the second warp knitting yarn is knitted between all wales of the fastener element attaching portion.

7. The knitted slide fastener according to claim 3, wherein the second warp knitting yarn is knitted in the ground structure between a first wale on an outermost side of the fastener element attaching portion and a second wale which is adjacent to the first wale.

8. The knitted slide fastener according to claim 3, wherein the fixing chain knitting yarn is knitted in a wale of the tape body which is most adjacent to the fastener element attaching portion.

* * * * *

UNITED STATES PATENT AND TRADEMARK OFFICE

CERTIFICATE OF CORRECTION

PATENT NO. : 9,320,327 B2
APPLICATION NO. : 13/517986
DATED : April 26, 2016
INVENTOR(S) : Yoshito Ikeguchi et al.

It is certified that error appears in the above-identified patent and that said Letters Patent is hereby corrected as shown below:

On the Title page, in item (56), in column 2, under "Other Publications", line 1, delete "Internationai" and insert -- International --, therefor.

In the Specification

In column 2, line 43, delete "aground" and insert -- a ground --, therefor.

Signed and Sealed this
Second Day of August, 2016

Michelle K. Lee

Michelle K. Lee
*Director of the United States Patent and Trademark Office*